US006352429B1

(12) United States Patent
Sher

(10) Patent No.: US 6,352,429 B1
(45) Date of Patent: Mar. 5, 2002

(54) SAFETY LIGHTER WITH ROTARY WHEEL HOODS

(75) Inventor: Tak Chi Sher, Hong Kong (HK)

(73) Assignee: Polycity Enterprise Limited (HK)

( * ) Notice: Subject to any disclaimer, the term of this patent is extended or adjusted under 35 U.S.C. 154(b) by 0 days.

(21) Appl. No.: 09/593,983

(22) Filed: Jun. 13, 2000

(51) Int. Cl.[7] ..... F23D 11/36; F23Q 1/02
(52) U.S. Cl. ..... 431/153; 431/276; 431/277
(58) Field of Search ..... 431/153, 144, 431/277, 274, 273, 255, 138, 267, 276

(56) References Cited

U.S. PATENT DOCUMENTS 5,547,370 A * 8/1996 Hwang ..... 431/277
5,584,683 A * 12/1996 Sher ..... 431/153
5,655,902 A * 8/1997 Doucet ..... 431/153
5,769,625 A * 6/1998 Sher ..... 431/153
5,882,186 A * 3/1999 Kai Man ..... 431/153
5,913,674 A * 6/1999 Shimizu ..... 431/153
5,971,749 A * 10/1999 Chen ..... 431/153
6,053,727 A * 4/2000 Potskhishvili et al. ..... 431/153
6,074,198 A * 6/2000 Rogelet ..... 431/153
6,123,541 A * 9/2000 Yang ..... 431/153
6,142,768 A * 11/2000 Feng et al. ..... 431/153
6,168,421 B1 * 1/2001 Hsieh ..... 431/153

FOREIGN PATENT DOCUMENTS

WO WO 98/04869 * 2/1998

* cited by examiner

*Primary Examiner*—Ira S. Lazarus
*Assistant Examiner*—Josiah C. Cocks
(74) *Attorney, Agent, or Firm*—Jackson Walker L.L.P.

(57) ABSTRACT

A safety lighter with improved rotary wheel hoods surrounding the striker wheel. The hoods must be urged downwardly and simultaneously rotated to engage and rotate the striker wheel. By varying the arrangement of the annular inner and outer surfaces of the hoods having either smooth surfaces or protuberances thereon with the annular unrecessed lateral portions of the striker wheel having either smooth surfaces or protuberances thereon, a multiplicity of embodiments may be achieved. Each embodiment requires a varying level of downward pressure and rotational forces to cause the lighter to spark and ignite.

8 Claims, 18 Drawing Sheets

(b)

(a)

(b)

(a)

(b)

(a)

SAFETY LIGHTER WITH ROTARY WHEEL HOODS

BACKGROUND OF THE INVENTION

The present invention relates to the field of lighters, such as cigarette lighters. More particularly the invention relates to safety lighters having rotary striker wheels. U.S. Pat. No. 5,769,625, which is incorporated herein by reference for all purposes, discloses a state of the art safety lighter with an improved striker wheel and striker wheel mounting frame. The lighter has an igniter having a striker wheel which rotates about an axis in response to force applied to the wheel by a user's finger. The annular recessed center portion of the striker wheel's outer annular surface has protuberances formed thereon (or grooves formed therein), while the annular unrecessed lateral portions of the striker wheel's outer annular surface are smooth. Further, the striker wheel is mounted to the lighter in slots. The striker wheel is pressed from a first position having insufficient spring force to cause the lighter flint to spark when the striker wheel is rotated into a second position having sufficient spring force to cause the lighter flint to spark when the striker wheel is rotated.

While the depression of the striker wheel from a first position to a second position is an effective safety mechanism, the present invention provides an improvement whereby the rotoring striker wheel remains in the same position and rotates about the same horizontal axis. There is no up or down displacement of the striker wheel. Rather, the present invention utilizes rotary hoods which are displaced from a first position to a second position to engage the outer edges of the striker wheel to translate rotary motion to the wheel and ignite the lighter.

SUMMARY OF THE INVENTION

The present invention is a lighter comprising an igniter having a striker wheel which rotates about an axis in response to force applied to the wheel by a user's thumb (or any other finger or hand part). The striker wheel has an outer annular surface having an annular recessed center portion and annular unrecessed lateral portions.

The annular recessed portion has a rough surface with protuberances formed thereon (or grooves formed therein). The annular unrecessed lateral portions of the striker wheels may be smooth or have protuberances thereon, depending upon the embodiment.

Rotary wheel hoods circumferentially surround the annular unrecessed lateral portions of the striker wheel. The hoods have inner and outer annular surfaces. The hoods also have a central opening formed therethrough to rotatably receive the central axle of the striker wheel. The central opening has a diameter greater than the diameter of the central axle. Thus, the rotary wheel hoods are movable from a first position where the inner surface of the hoods do not contact the striker wheel to a second position where the inner surface of the hoods engage the striker wheel along the annular unrecessed lateral portions and impart rotational movement to the striker wheel to create sparks. The sparks ignite the lighter when the igniter is activated. The inner and outer surfaces of the hoods may be smooth or have protuberances thereon, again, depending upon the embodiment of the invention.

BRIEF DESCRIPTION OF THE DRAWINGS

FIG. 3A*b* is an assembled perspective detailed view of the portion of the lighter shown in FIG. 2A having smooth lateral portion surfaces of the striker wheel showing no pressure being applied to the smooth inner and outer surfaces of the rotary wheel hoods.

FIG. 3B*b* is an assembled perspective detailed view of the portion of the lighter shown in FIG. 2B having smooth surfaces on the lateral portion of the striker wheel showing no pressure being applied to the rotary wheel hoods having smooth inner surfaces and protuberances on the outer surfaces.

FIG. 3C*b* is an assembled perspective detailed view of the portion of the lighter shown in FIG. 2C having smooth surfaces on the lateral portions of the striker wheel showing no pressure being applied to the rotary wheel hoods having protuberances on the inner surfaces and smooth outer surfaces.

FIG. 4A*b* is a partial side elevation view of the inventive aspects of the invention of FIG. 3A*b*, partially broken away and sectioned.

FIG. 4B*b* is a partial side elevation view of the inventive aspects of the invention of FIG. 3B*b*, partially broken away and sectioned.

FIG. 4C*b* is a partial side elevation view of the inventive aspects of the invention of FIG. 3C*b*, partially broken away and sectioned.

FIG. 5A*b* is the view shown in FIG. 3A*b* but with pressure being applied to the rotary wheel hoods.

FIG. 5B*b* is the view shown in FIG. 3B*b* but with pressure being applied to the rotary wheel hoods.

FIG. 5C*b* is the view shown in FIG. 3C*b* but with pressure being applied to the rotary wheel hoods.

FIG. 6A*b* is the side view shown in FIG. 4A*b* but with pressure being applied to the rotary wheel hoods.

FIG. 6B*b* is the side view shown in FIG. 4B*b* but with pressure being applied to the rotary wheel hoods.

FIG. 6C*b* is the side view shown in FIG. 4C*b* but with pressure being applied to the rotary wheel hoods.

DETAILED DESCRIPTION OF THE INVENTION

Figure 1A:
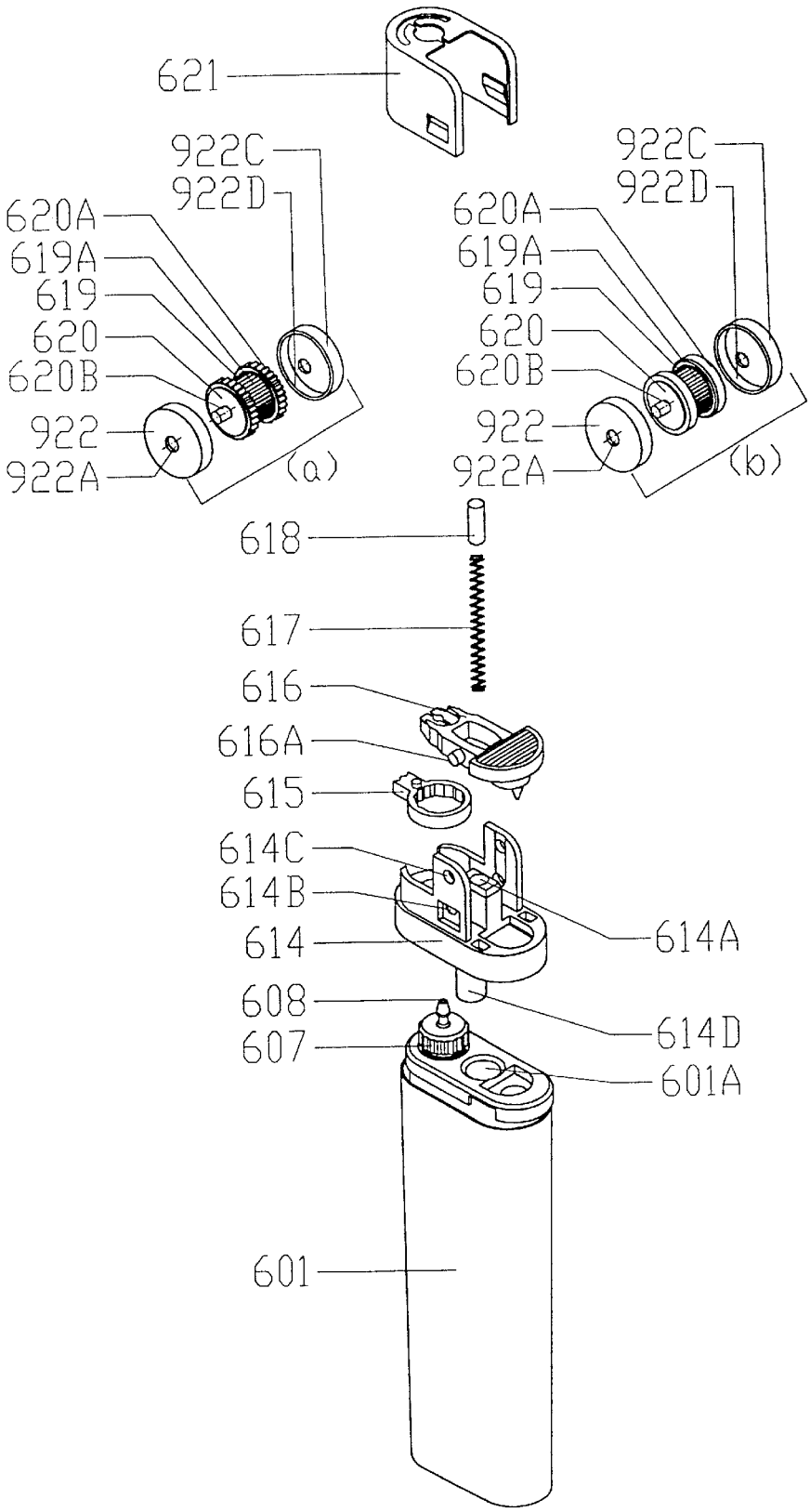
FIG. 1A is an exploded view of the safety lighter of the present invention showing (a) a striker wheel with protuberances on the outer portions and (b) a striker wheel having a smooth surface on the lateral portions. The rotary wheel hoods have smooth inner and outer surfaces.

The preferred embodiment of the invention is illustrated in the attached drawings which are referred to herein. The same reference numeral will be used to identify identical elements throughout the drawings.

Figure 1B:
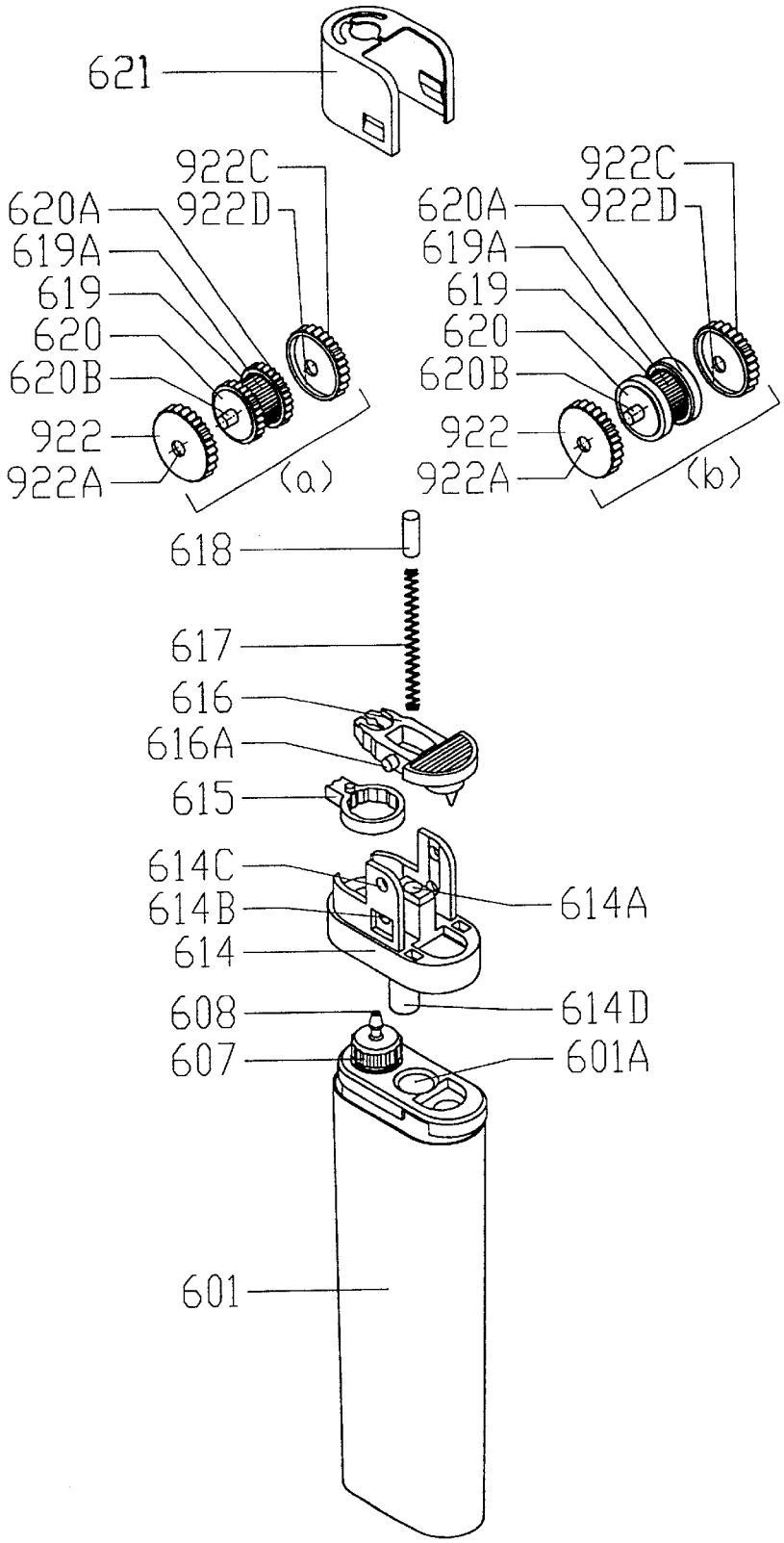
FIG. 1B is an exploded view of the safety lighter of the present invention showing (a) a striker wheel with protuberances on the outer portions and (b) a striker wheel having a smooth surface on the lateral portions. The rotary wheel hoods have smooth inner surfaces and protuberances on the outer surface.
Figure 1C:
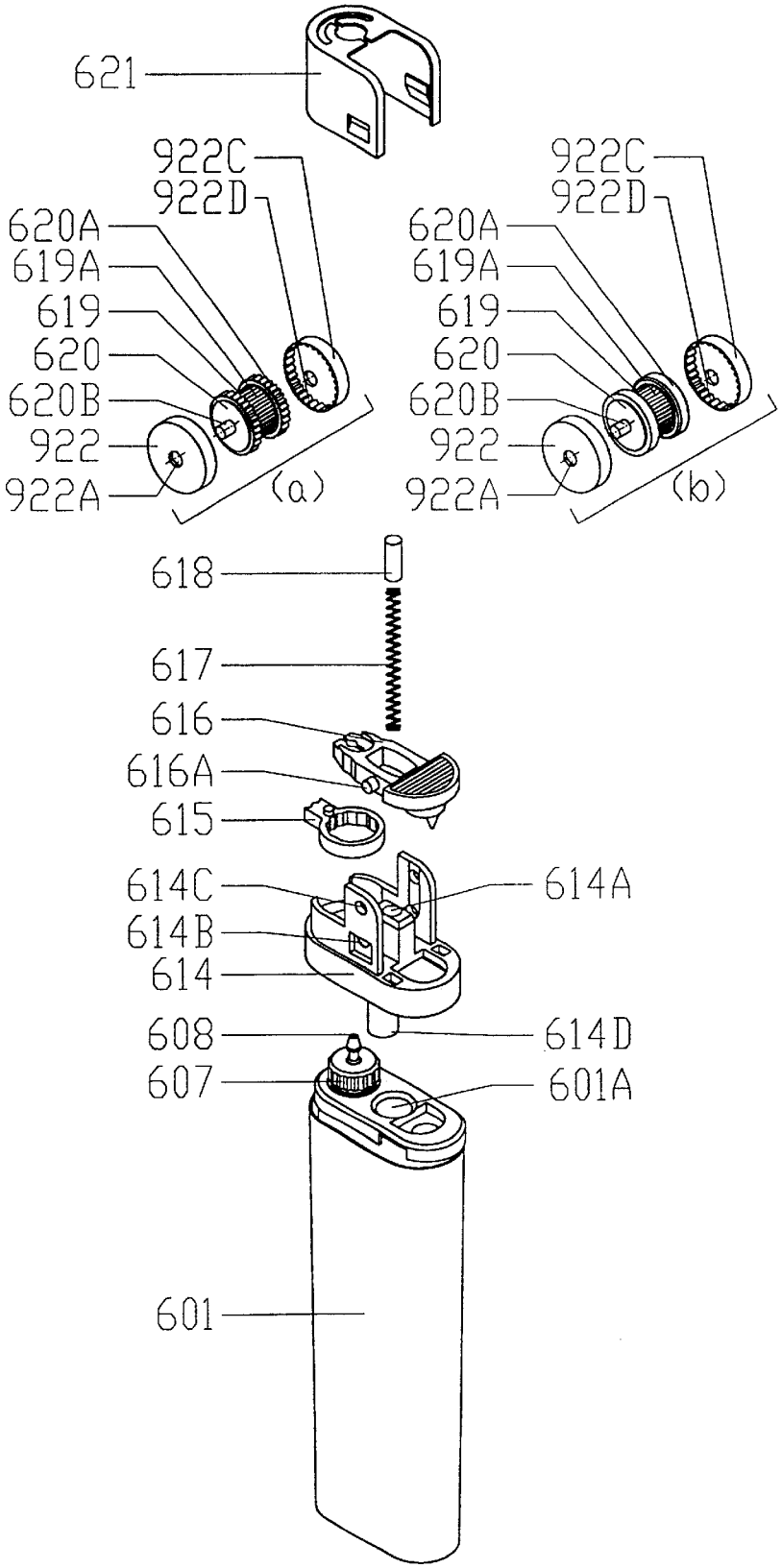
FIG. 1C is an exploded view of the safety lighter of the present invention showing (a) a striker wheel with protuberances on the outer portions and (b) a striker wheel having a smooth surface on the lateral portions. The rotary wheel hoods have protuberances on the inner surface and a smooth outer surface.

FIGS. 1A–1C illustrate components commonly mounted on a lighter body 601 in which lighter fuel is contained. Such components include nozzle 608 having a head and a downwardly extending tube disposed toward the front of the lighter body 601, flame adjustment wheel 607 and thumb adjustment actuator 615 which is connected to the flame adjustment wheel, mounting frame 614, windshield 621, nozzle actuating lever 616, and an igniter comprising flint spring 617, flint 618, and striker wheel 620.

The tube of the nozzle is connected in communication relationship with the interior of the lighter body where, as mentioned above, fuel is stored. The nozzle may be moved from a lower position to an upper position. When the nozzle is in its lower position, fuel cannot be ejected from it. When the nozzle is in the upper position, fuel is ejected from it. In normal operation, a lighter's striker wheel is rotated and the rear of lever 616 is depressed virtually simultaneously, which causes the nozzle to be raised and a spark to be created when the teeth of the striker wheel fictionally engage the flint 618. The spark ignites the fuel and a flame is maintained so long as the rear of the lever is continued to be depressed downward.

Frame 614 is mounted on the lighter body with hollow frame stem 614D inserted in hole 601A of the lighter body. Nozzle actuating lever 616 is mounted on the frame with pivots 616A inserted into slots 614B. Striker wheel 620 is formed in the shape of a wheel having an annular center portion 619 of its outer annular surface recessed relative to the annular lateral portions 620A of the striker wheel's outer annular surface. The striker wheel is mounted on frame 614 with the wheel's axle 620B fitting into holes 614C. Flint 618 and flint spring 617 are mounted in hole 614A of the mounting frame in the conventional fashion so as to urge the flint 618 toward protuberances 619A which are disposed on the annular recessed surface 619 of the striker wheel.

Figure 4A:
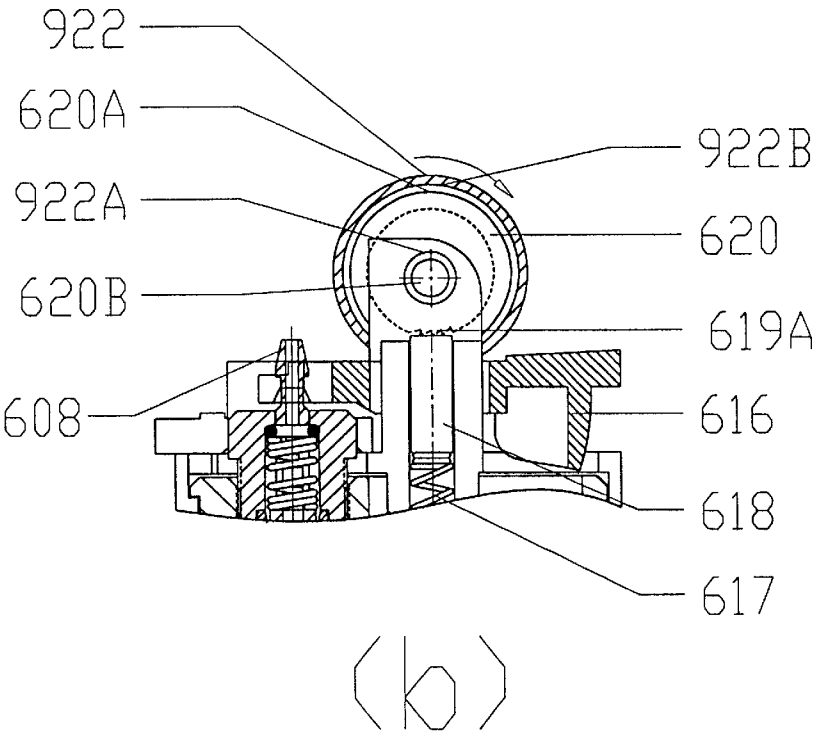
FIG. 4A*a* is a partial side elevation view of the inventive aspects of the invention of FIG. 3A*a*, partially broken away and sectioned.
Figure 4A:
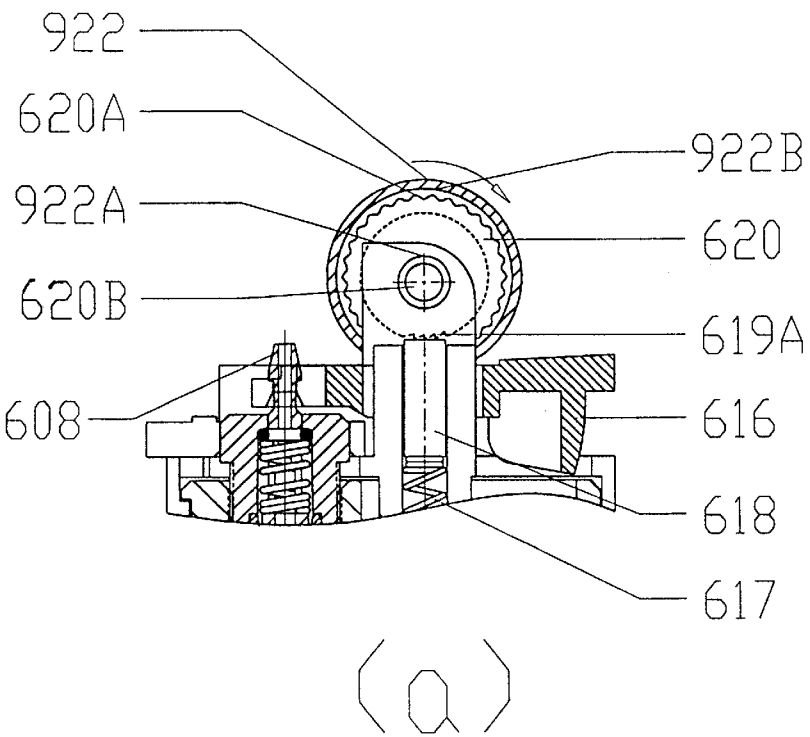
Figure 4B:
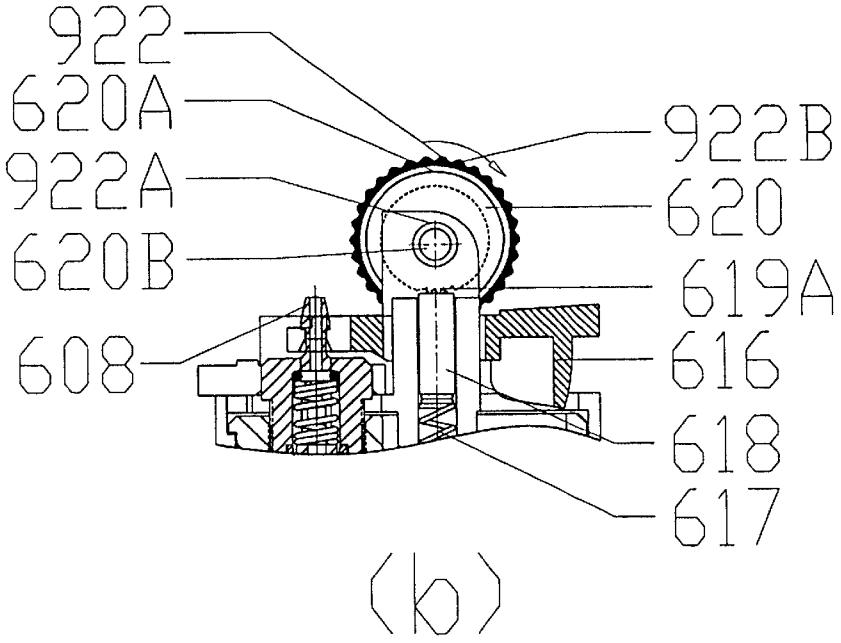
FIG. 4B*a* is a partial side elevation view of the inventive aspects of the invention of FIG. 3B*a*, partially broken away and sectioned.
Figure 4B:
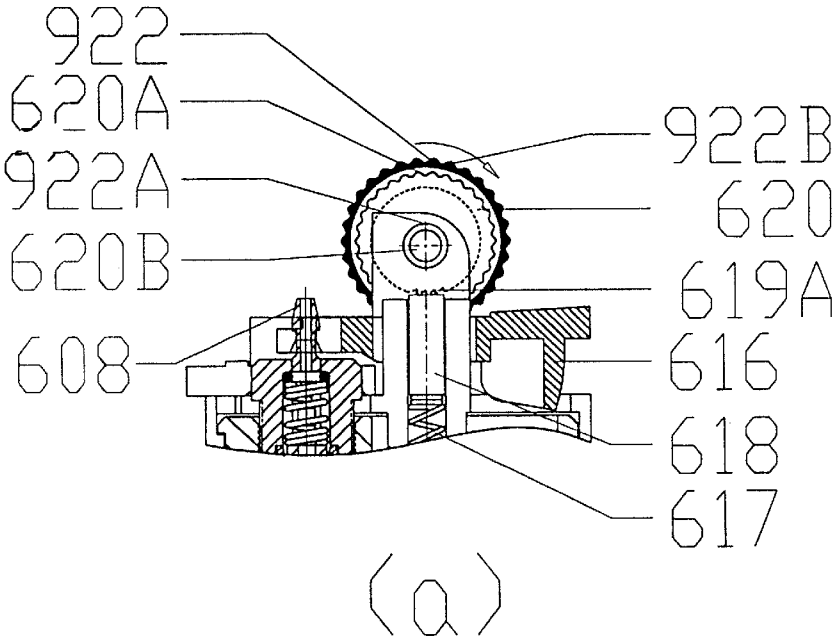
Figure 4C:
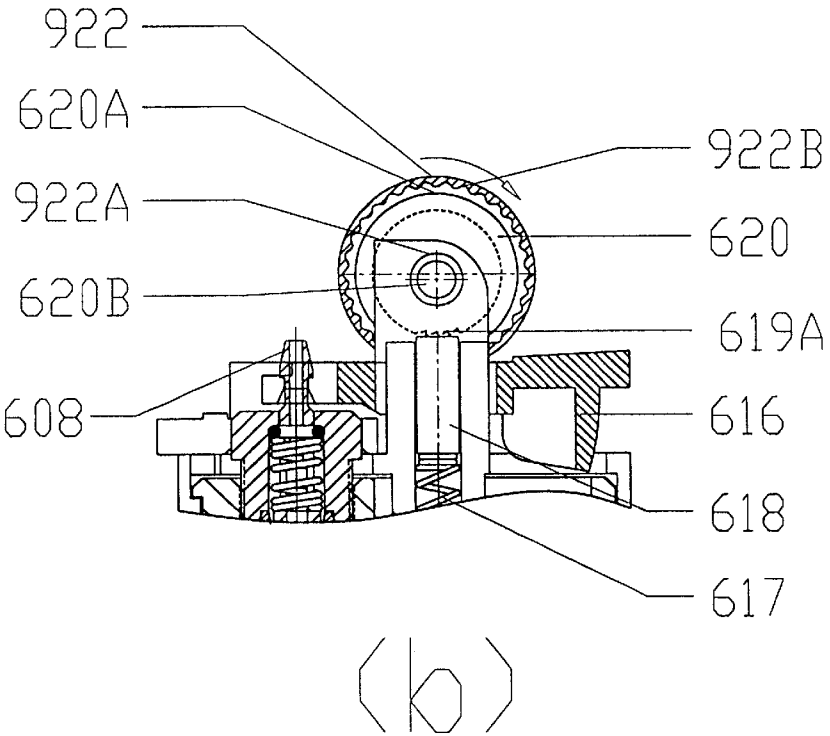
FIG. 4C*a* is a partial side elevation view of the inventive aspects of the invention of FIG. 3C*a*, partially broken away and sectioned.
Figure 4C:
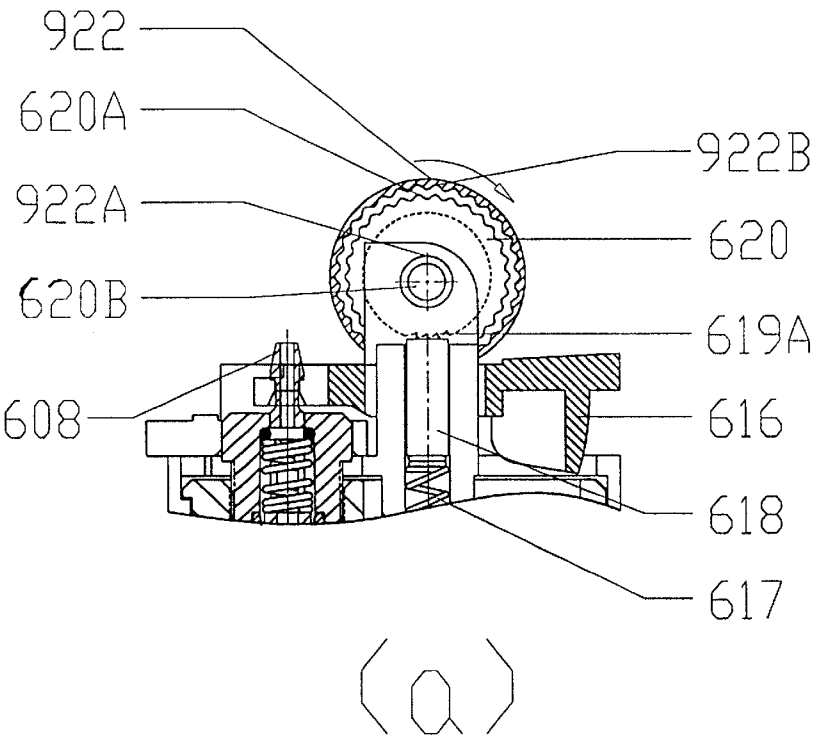

The protuberances 619A on annular recessed center portion 619 are a series of saw-tooth-shaped teeth, each having a first surface which is substantially perpendicular to the tangent of the circle from which the protuberances extend. This first surface faces in the clockwise direction as the lighter is viewed from the side shown in FIG. 4A*a*. Each tooth also has a second surface, which slopes toward the counter-clockwise direction of the wheel when the lighter is viewed from its side with the front (or nozzle) end of the lighter toward the left as shown in FIG. 4A*a*.

FIGS. 1A–1C illustrate that same general arrangement may be utilized in each embodiment of the invention. The principal difference with each embodiment relates to the rotary wheel hoods 922 and the annular unrecessed lateral portions 620A of striker wheel 620.

Turning now to the inventive rotary wheel hoods 922, it may be seen that the hoods are cap-like shrouds which circumferentially surround the annular unrecessed lateral portions 620A of the striker wheel 620. The hoods have inner 922D and outer 922C annular surfaces. Each hood has a central axle opening 922A formed therethrough to rotatably receive the central axle 620B of the striker wheel. The diameter of the axle opening 922A is greater than the diameter of the axle 620B. Further, the inner diameter $d_i$ of the rotary wheel hood 922 is greater than the diameter $d_w$ of the annular unrecessed lateral portions 620A of the striker wheel 620. Thus, the striker wheel 620 cannot be actuated or rotated even if the rotary wheel hoods 922 are rotated. Only by pressing or urging downwardly upon the outer annular surface 922C of the hoods 922 while simultaneously rotating the hoods may the striker wheel 620 be rotated about its axle 620B.

As may be seen in the various figures, the inner annular surface 922D may be smooth or may have protuberances thereon. In the same way the outer annular surface 922C may be smooth or may have protuberances thereon. Likewise, the annular unrecessed lateral portions 620A of the striker wheel 620 may have protuberances (arrangement b, FIG. 1A) or be smooth (arrangement a, FIG. 1A).

FIG. 1A illustrates both inner and outer annular surfaces of the hoods 922 as being smooth, but the annular unrecessed lateral portion 620A of the striker wheel 620 may be smooth (b) or have protuberances (a). The amount of pressure which must be applied to the hoods 922 to cause rotation of the striker wheel 620 will vary depending upon the arrangement of the smoother versus protuberanced surfaces of the hoods and the smooth versus protuberanced surfaces of the annular unrecessed lateral portions 620A of the striker wheel 620.

FIG. 1B illustrates hoods 922 having smooth inner surfaces 922D and outer surfaces 922C having protuberances. Again, the striker wheel is shown having protuberances in arrangement (a) while in arrangement (b) these unrecessed lateral portions 620A are smooth. Flint 618 and spring 617 are assembled into hole 614A of the mounting frame. Under action of spring 617, the upper end of the flint 618 is urged against the under side of the recessed portion 619 of the striker wheel 620. In this first position, if a child rotates outer surface 922C of the hood 922 in the clockwise direction, only the hood 922 will rotate while the striker wheel 620 will not rotate because the diameter of the axle opening 922A of the hood 922 is larger than that of the axle 620A and the inner diameter $d_t$ of the hood 922 is greater than the diameter $d_w$ of the annular unrecessed lateral portions 620A.

FIG. 1C shows hoods 922 having protuberances on the annular inner surfaces 922D and annular outer surfaces 922C being smooth. Arrangement (a) of the striker wheel 620 shows lateral portions with protuberances and arrangement (b) shows lateral portions being smooth. Operation in the first position of the hoods, with no downwardly urging pressure, is the same as in FIGS. 1A and 1B.

Figure 2A:
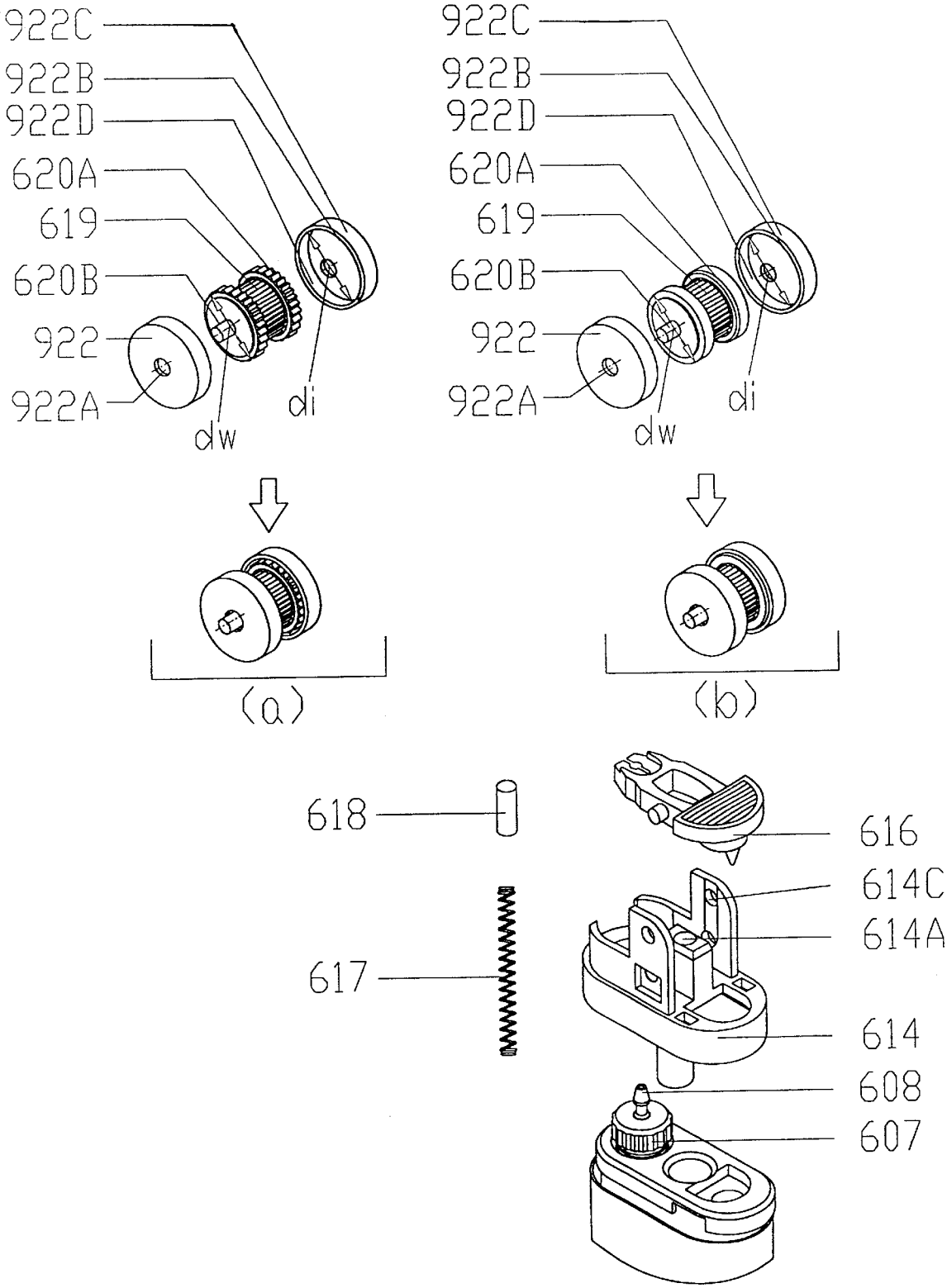
FIG. 2A is an exploded detail view of that portion of the lighter shown in FIG. 1A and more clearly shows the inventive aspects of the present invention.
Figure 2B:
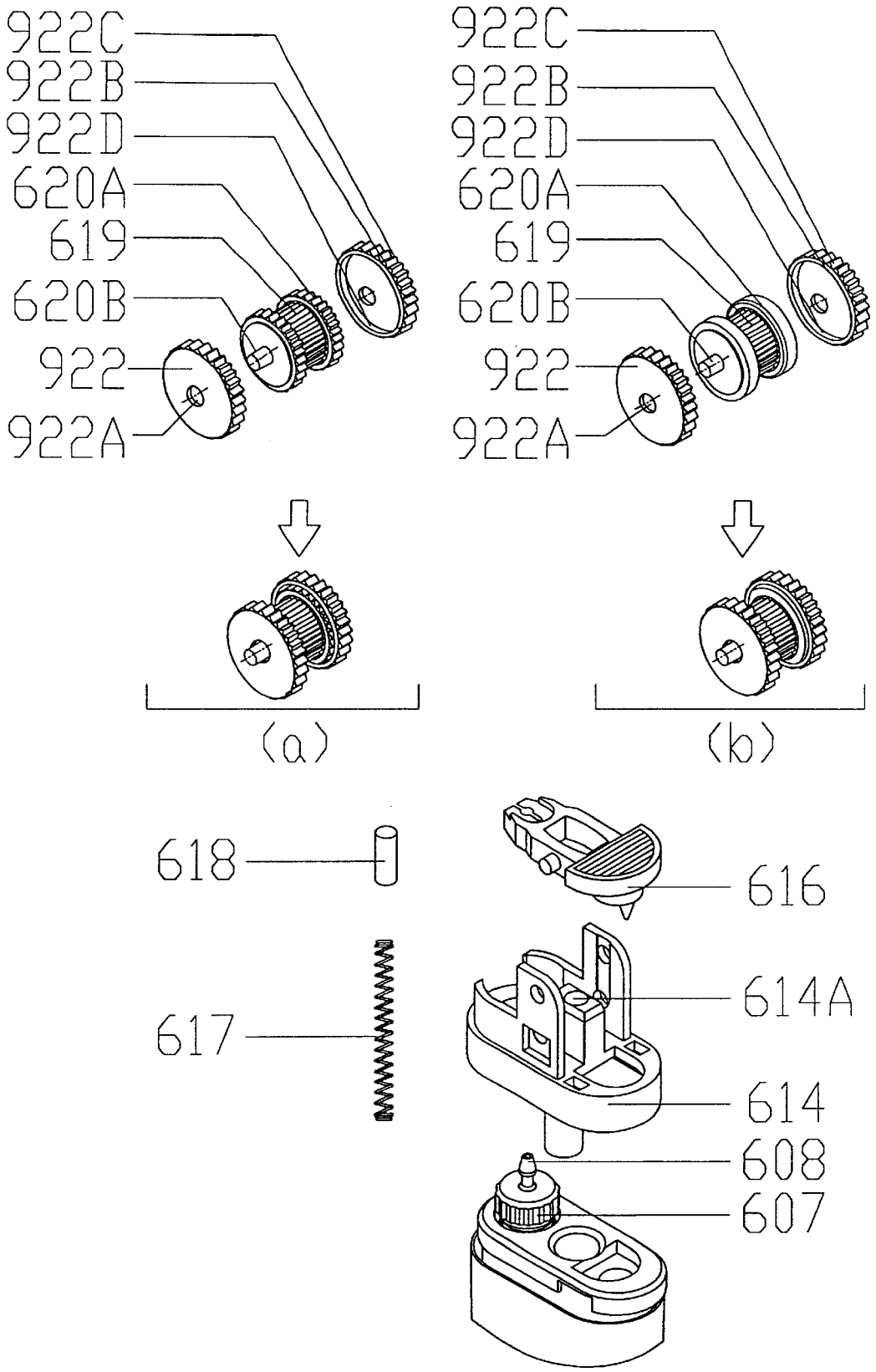
FIG. 2B is an exploded detail view of that portion of the lighter shown in FIG. 1B and more clearly shows the inventive aspects of the present invention.
Figure 2C:
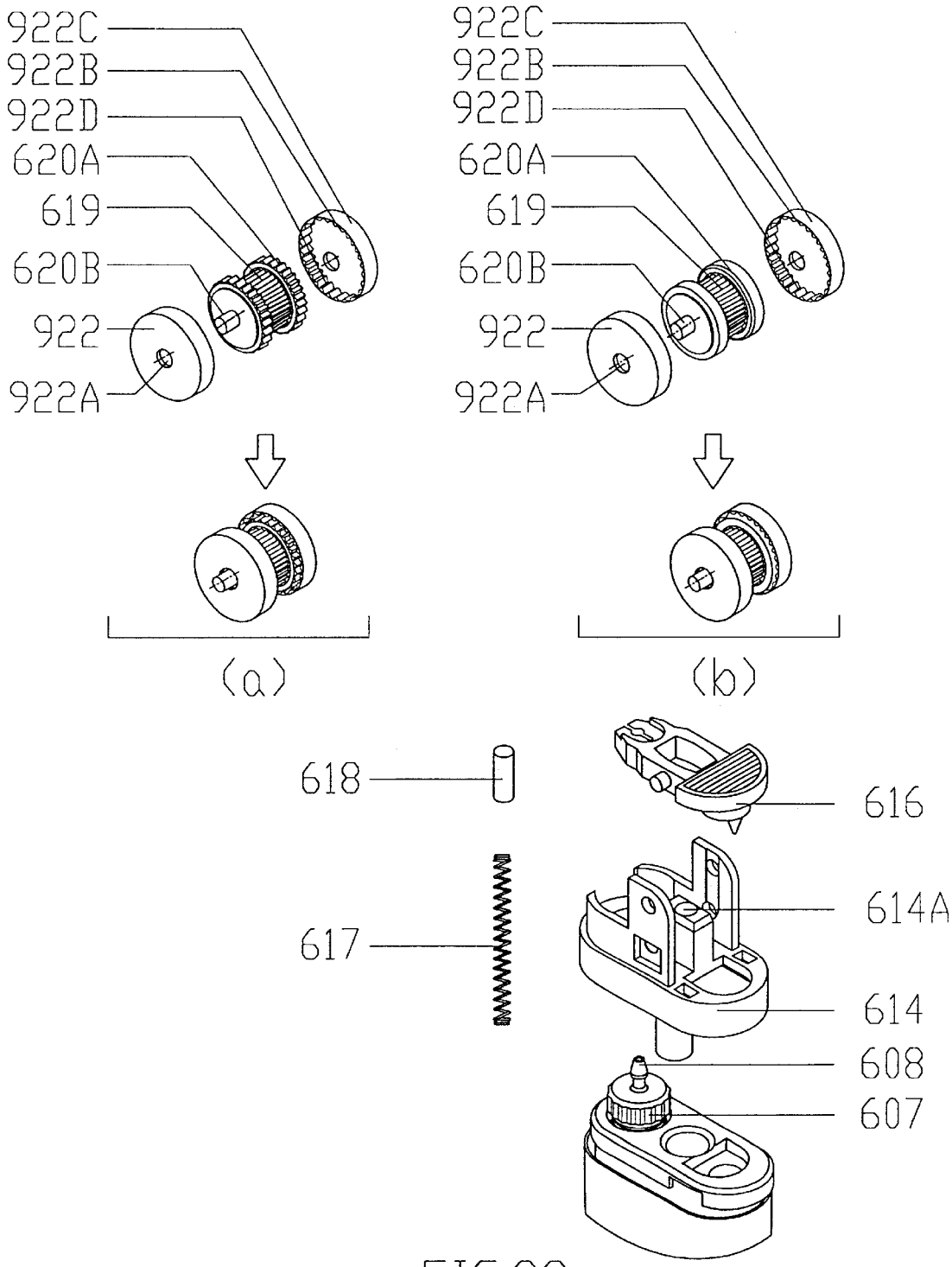
FIG. 2C is an exploded detail view of that portion of the lighter shown in FIG. 1C and more clearly shows the inventive aspects of the present invention.

FIGS. 2A–2C illustrate detailed views of the upper portion of the lighters of FIGS. 1A–1C, respectively, and more clearly show the inventive aspects of the hoods 922. Operation has been discussed previously.

Figure 3A:
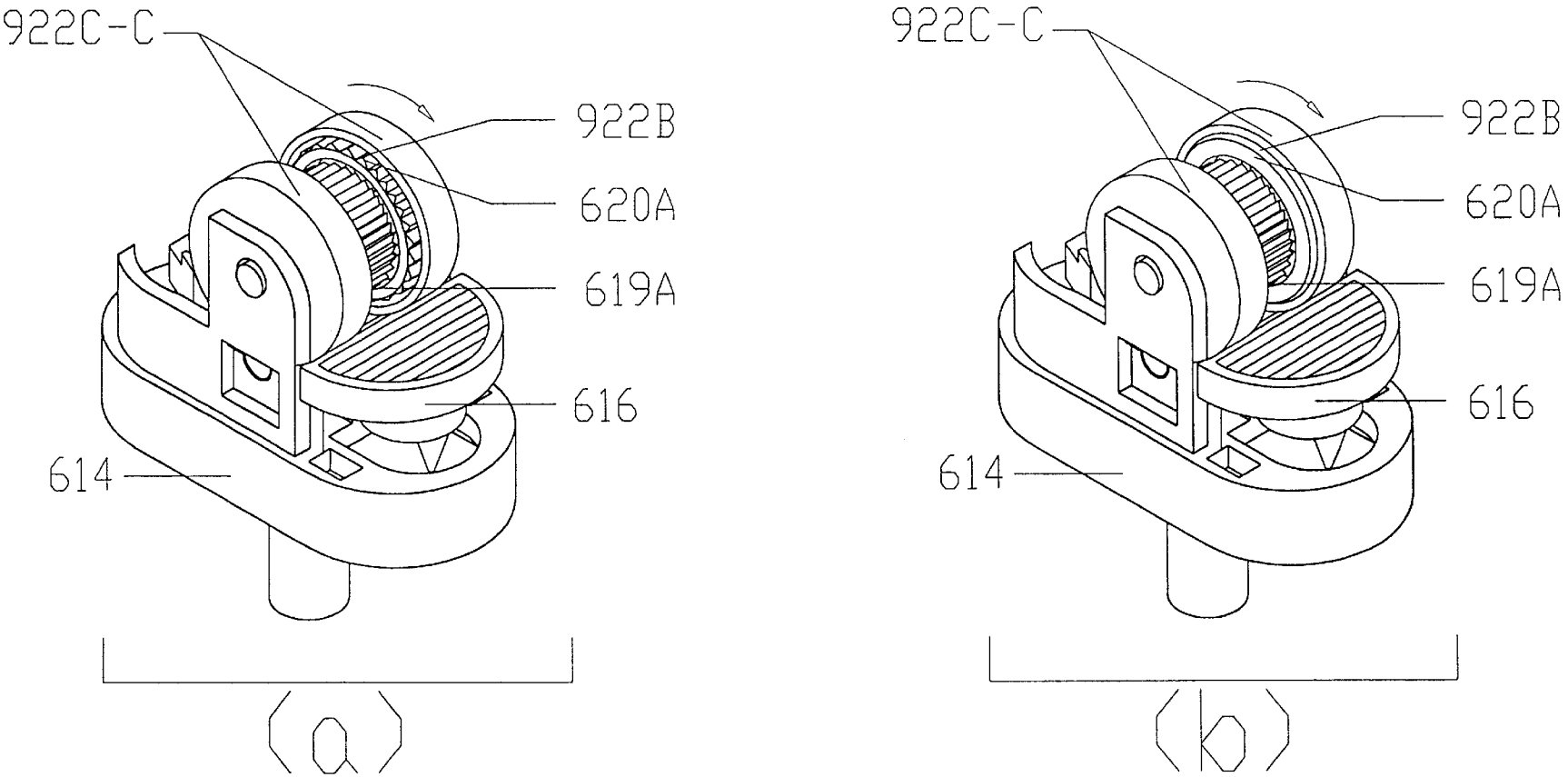
FIG. 3A*a* is an assembled perspective detailed view of the portion of the lighter shown in FIG. 2A having protuberances on the lateral portion of the striker wheel showing no pressure being applied to the smooth inner and outer surfaces of rotary wheel hoods.

FIG. 3A(*a*) shows an assembled perspective detailed view of the portion of the lighter shown in FIG. 2A (arrangement (a)) illustrating smooth outer hood surfaces 922C, smooth inner hood surfaces 922A, and protuberances on annular unrecessed lateral portions 620A of striker wheel 620. Further shown are the frame 614 and the ignition lever 616. FIG. 3A(*b*) illustrates an assembled perspective detailed view of the portion of the lighter shown in FIG. 2A arrangement (b) showing smooth outer hood surfaces 922C, smooth inner hood surfaces 922A, and smooth surfaces on annular unrecessed lateral portions 620A of striker wheel 620.

Figure 3B:
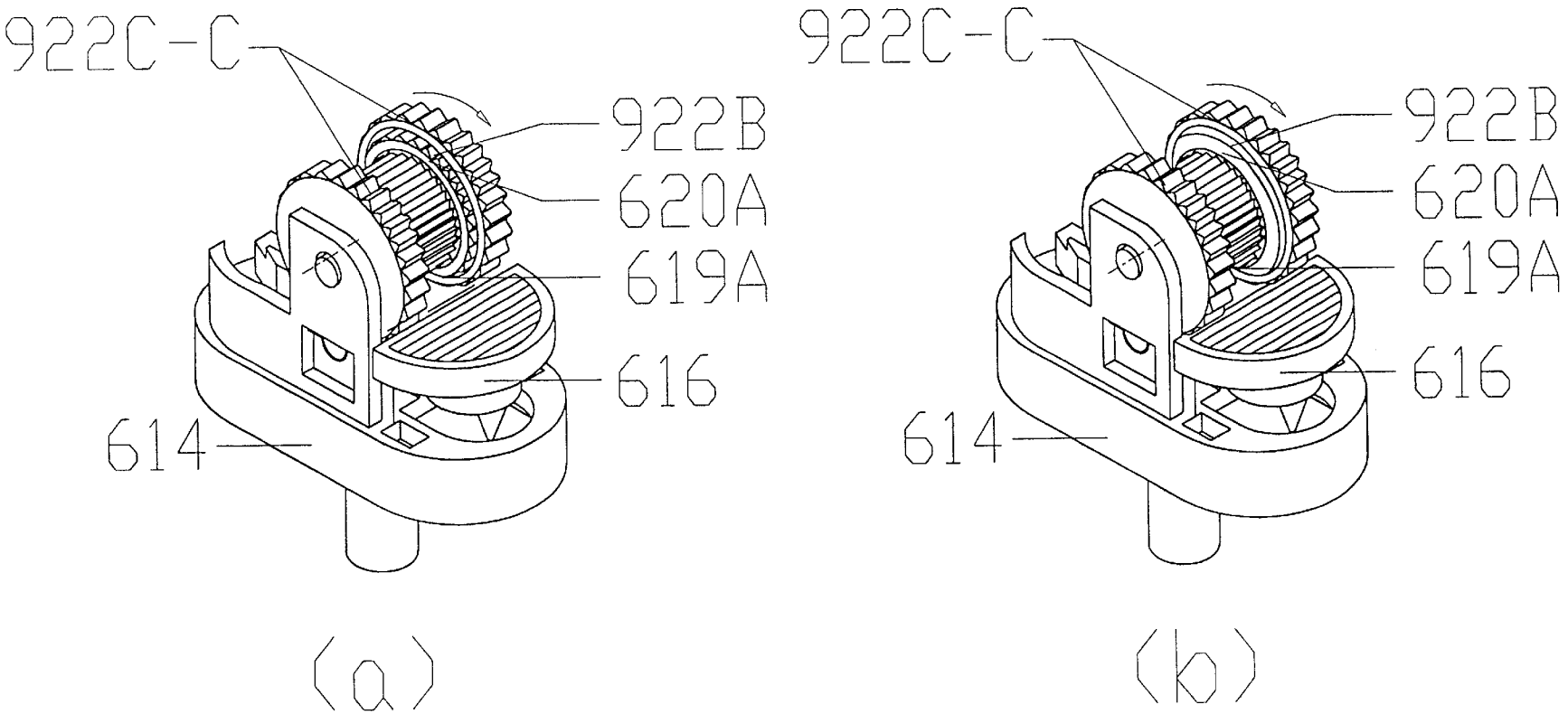
FIG. 3B*a* is an assembled perspective detailed view of the portion of the lighter shown in FIG. 2B having protuberances on the lateral portions of the striker wheel showing no pressure being applied to the rotary wheel hoods having smooth inner surfaces and protuberances on the outer surfaces.
Figure 3C:
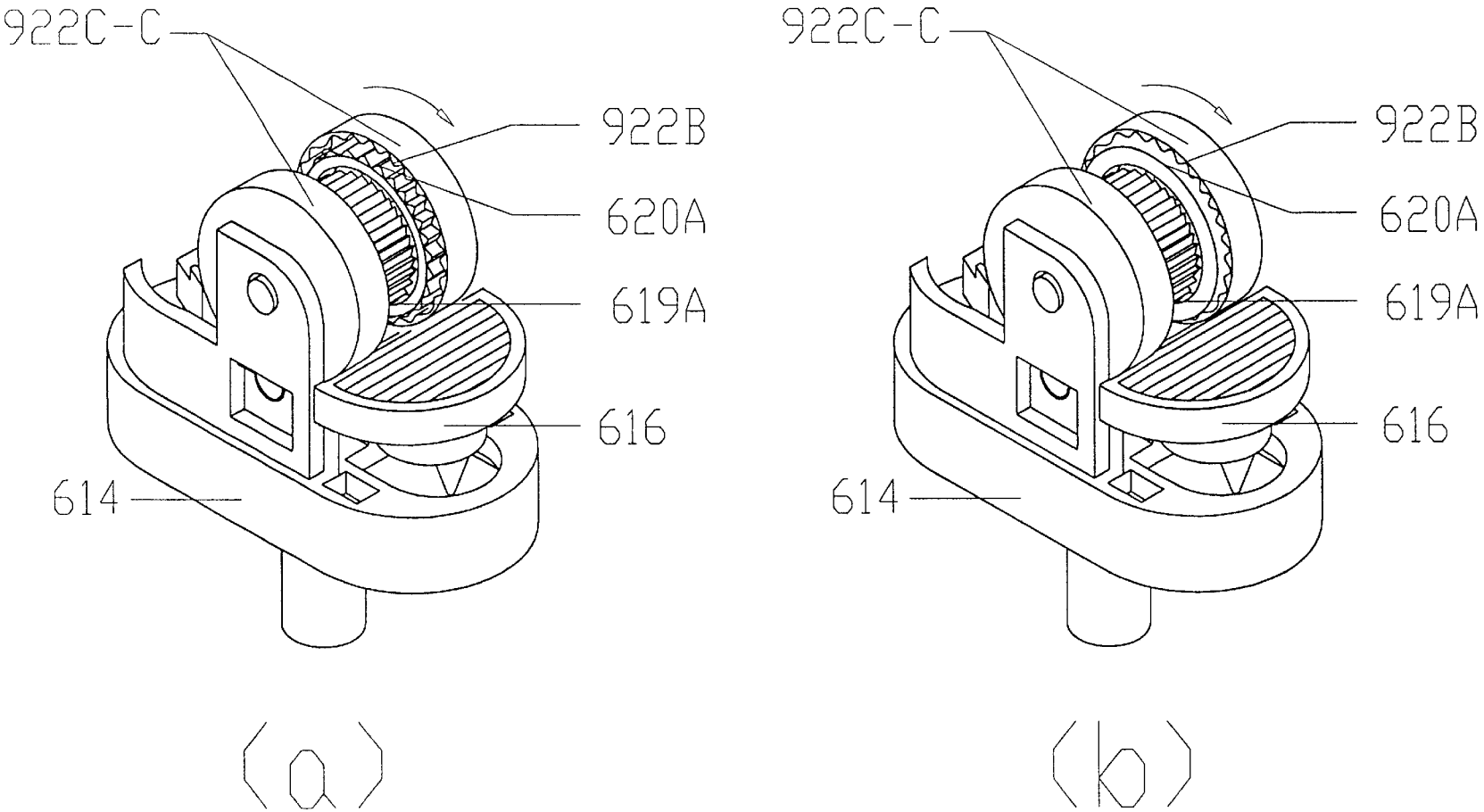
FIG. 3C*a* is an assembled perspective detailed view of the portion of the lighter shown in FIG. 2C having protuberances on the lateral portions of the striker wheel showing no pressure being applied to the rotary wheel hoods having protuberances on the inner surfaces and smooth outer surfaces.

FIG. 3B(*a*) corresponds as noted above with FIG. 2B arrangement (a), and FIG. 3B(*b*) corresponds with FIG. 2B arrangement (b). FIG. 3C(*a*) corresponds as noted above with FIG. 2C arrangement (a), and FIG. 3C(*b*) corresponds with FIG. 2C arrangement (b).

FIGS. 4A(*a*) and (*b*); 4B(*a*) and (*b*); and 4C(*a*) and 4(*b*) illustrate partial side elevation views of the inventive aspects of the invention shown in FIGS. 3A(*a*) and (*b*); 3B(*a*) and (*b*); and 3C(*a*) and (*b*), respectively. It should be noted in these partial side elevation views that no downward pressure has been applied to the hoods 922. The figures simply illustrate that the axle 620B is smaller in diameter than the axle opening 922A allowing the hoods to freely rotate without causing rotation of the striker wheel 620. The inner surface 922D of the hood does not urge against annular unrecessed lateral portions 620A of the striker wheel 620. Flint 618 may be seen pressing against striker wheel 620 as a result of the compressive force of spring 617. Nozzle 608 and lever 616 are also shown.

Figure 5A:
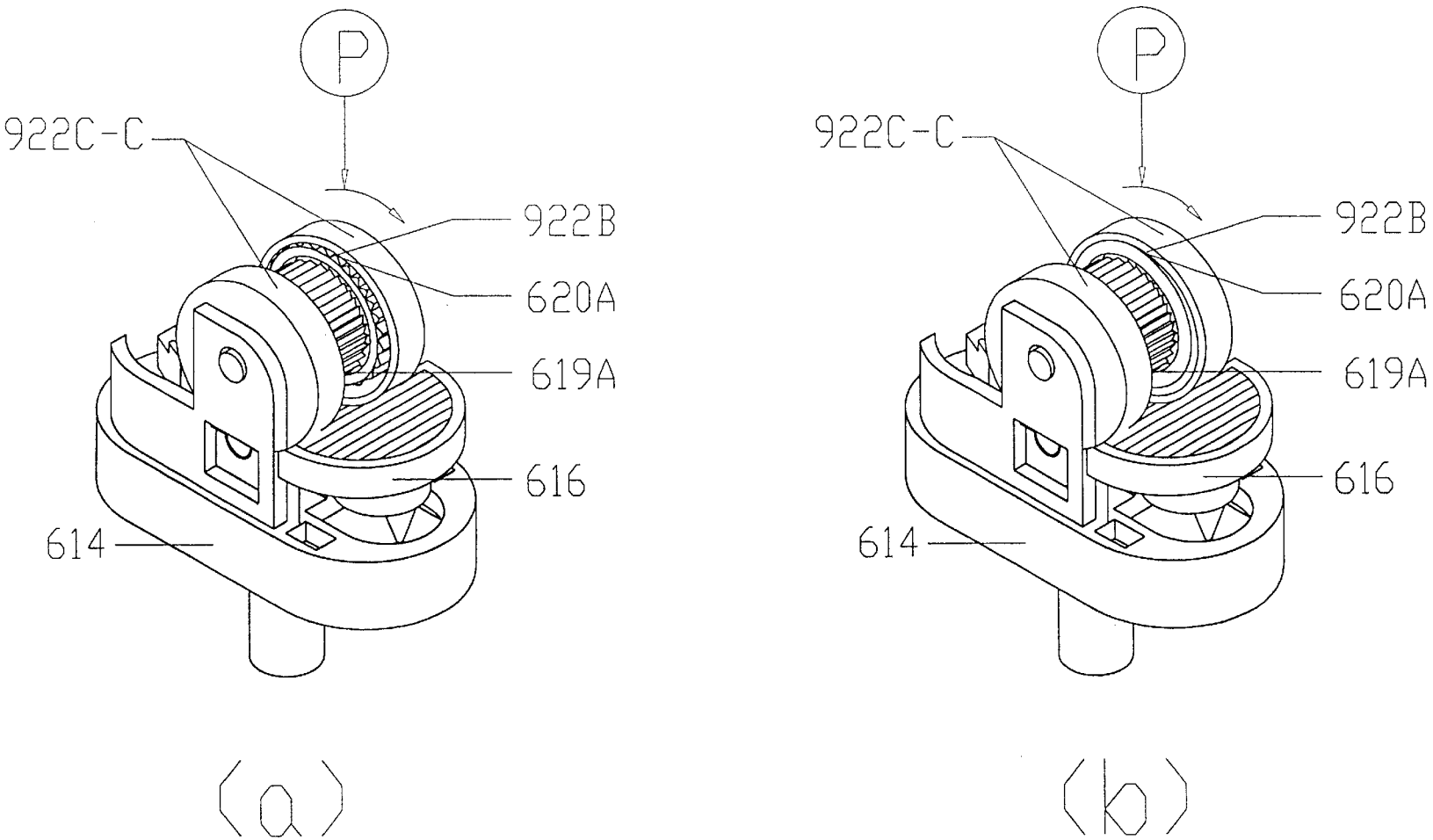
FIG. 5A*a* is the view shown in FIG. 3A*a* but with pressure being applied to the rotary wheel hoods.
Figure 5B:
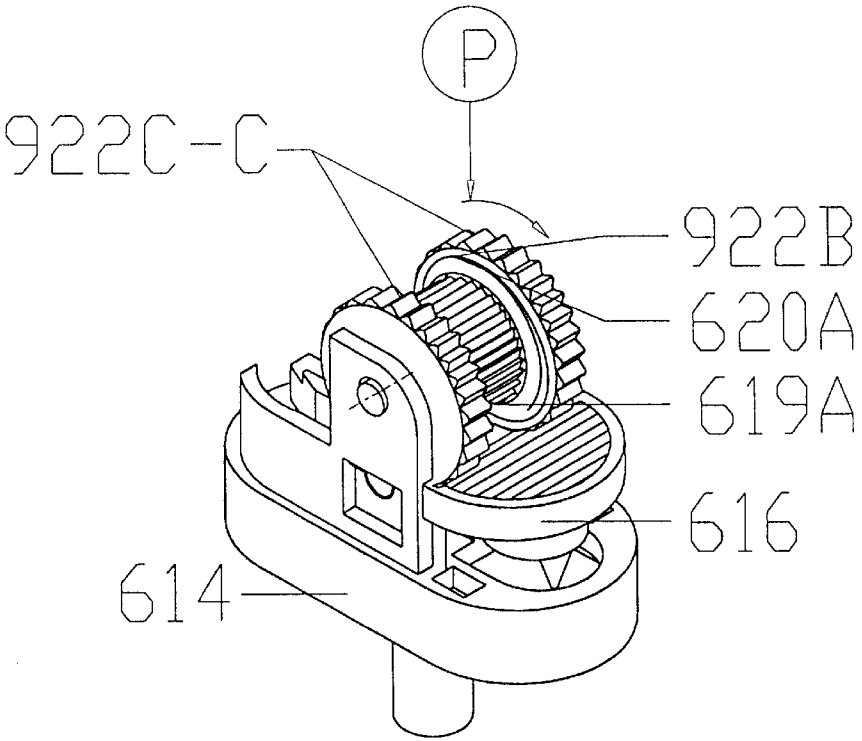
FIG. 5B*a* is the view shown in FIG. 3B*a* but with pressure being applied to the rotary wheel hoods.
Figure 5B:
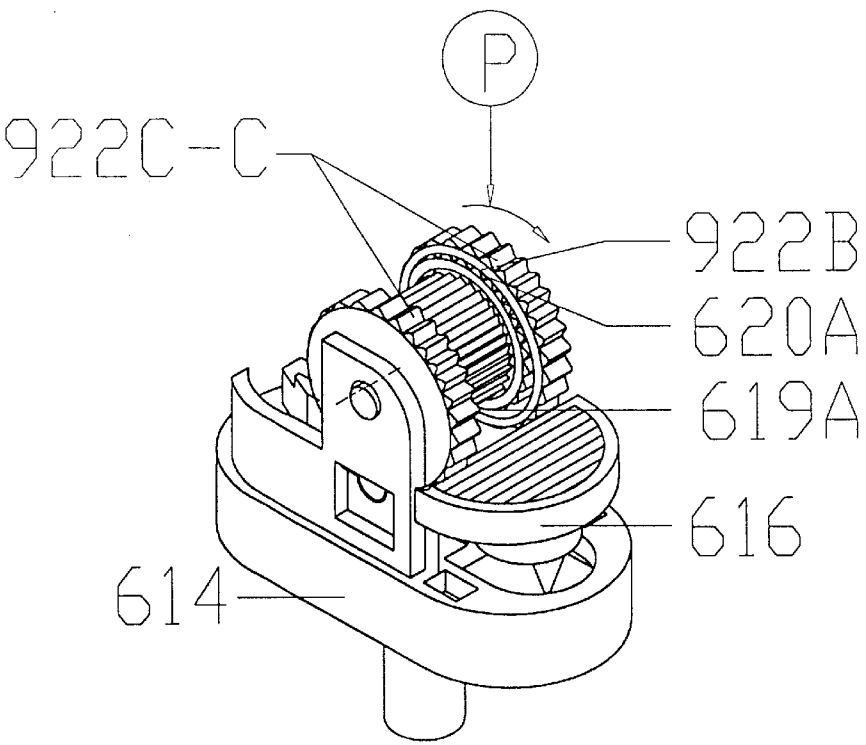
Figure 5C:
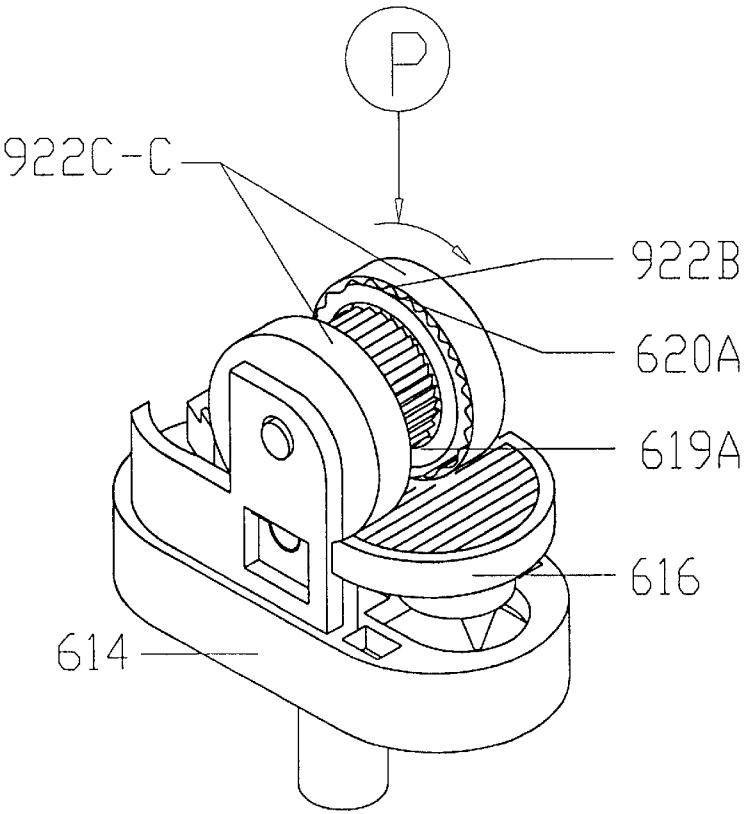
FIG. 5C*a* is the view shown in FIG. 3C*a* but with pressure being applied to the rotary wheel hoods.
Figure 5C:
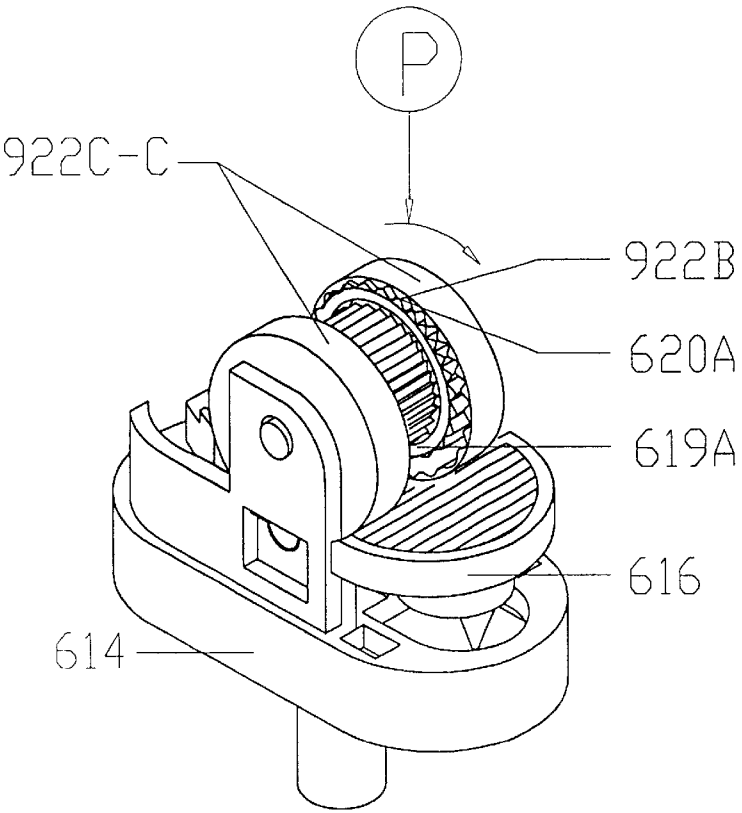
Figure 6A:
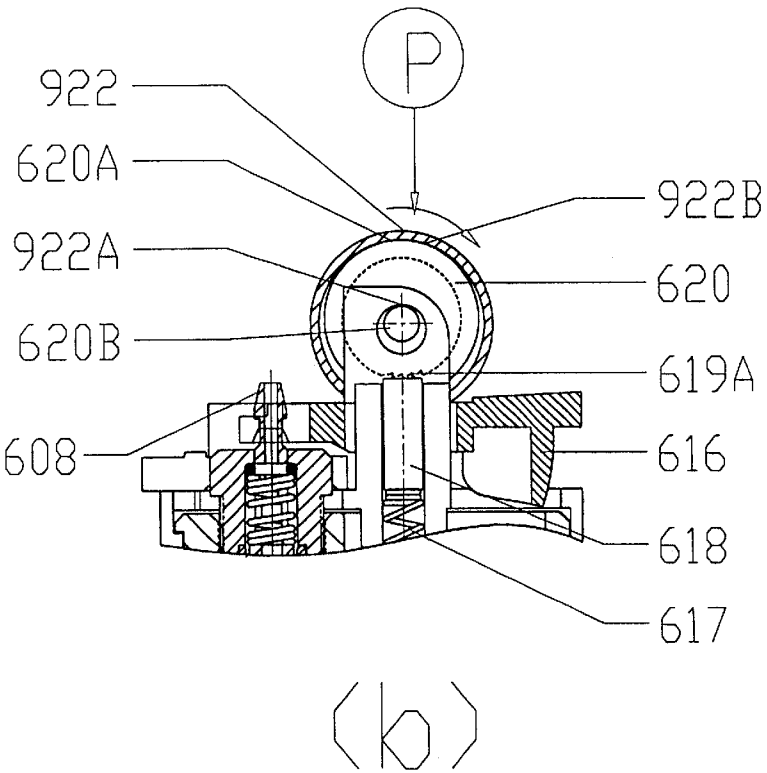
FIG. 6A*a* is the side view shown in FIG. 4A*a* but with pressure being applied to the rotary wheel hoods.
Figure 6A:
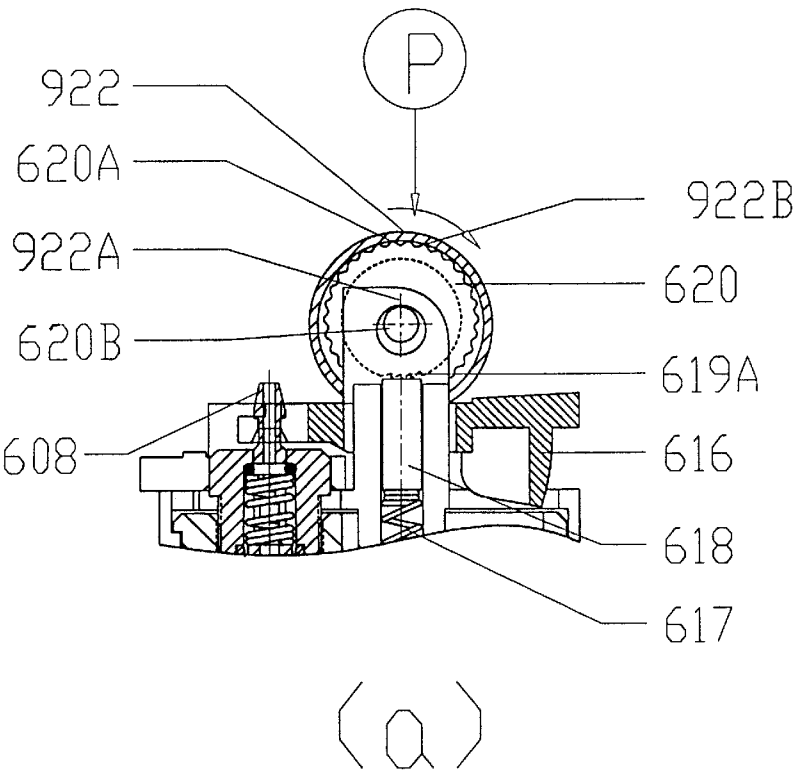
Figure 6B:
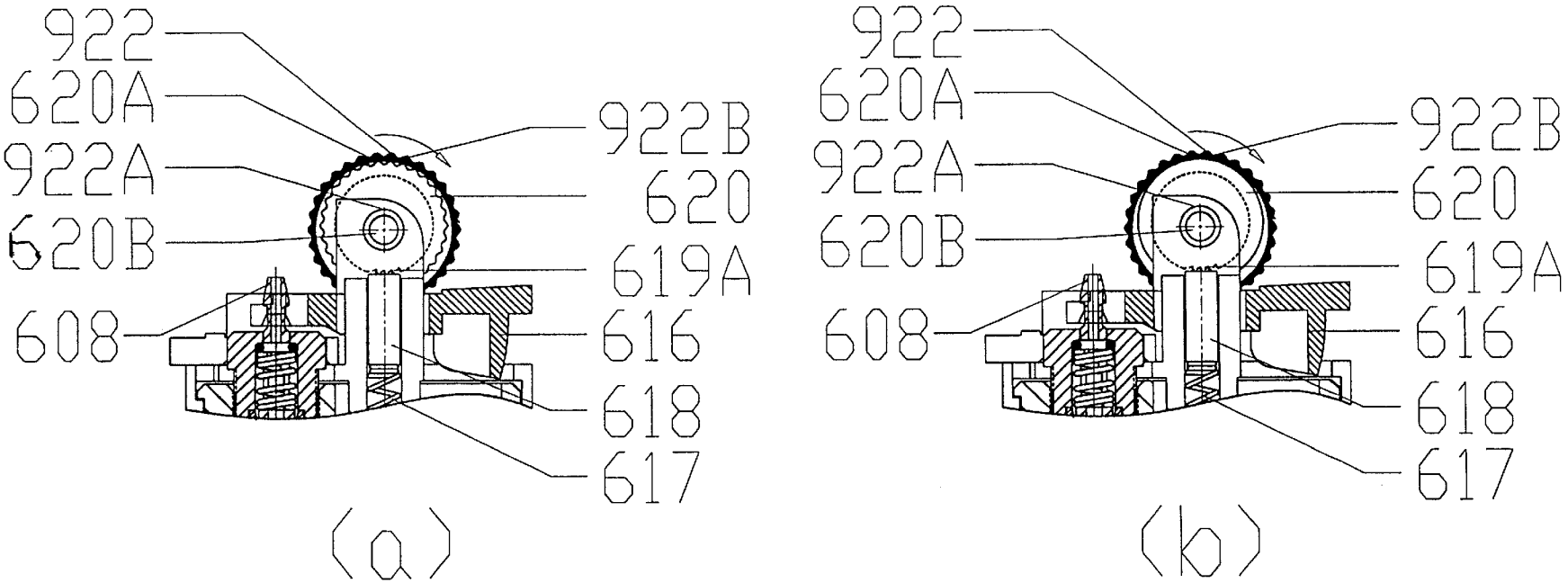
FIG. 6B*a* is the side view shown in FIG. 4B*a* but with pressure being applied to the rotary wheel hoods.
Figure 6C:
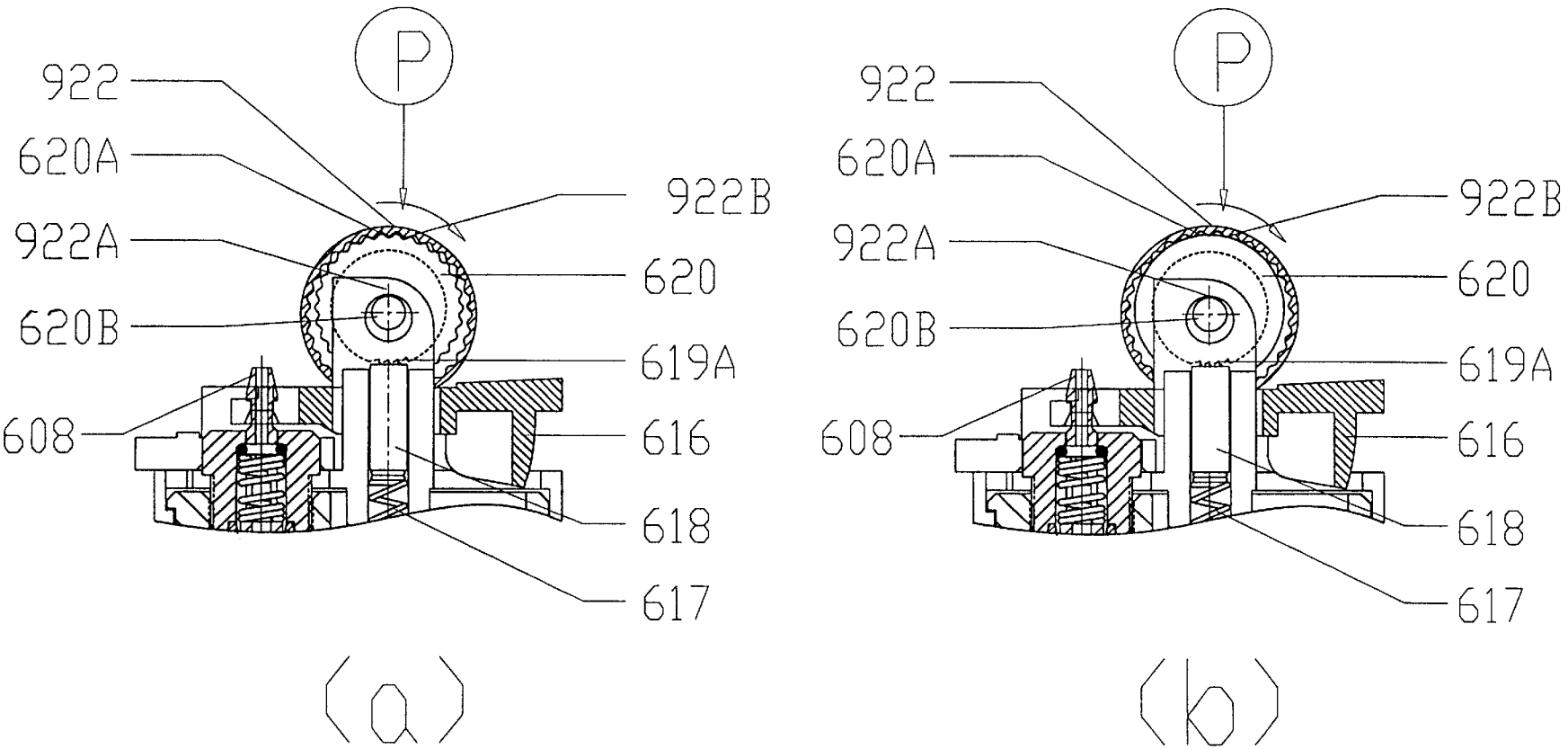
FIG. 6C*a* is the side view shown in FIG. 4C*a* but with pressure being applied to the rotary wheel hoods.

FIGS. 5A(*a*) through 6C(*b*) illustrate the operation of the present inventive safety lighter in a second operative position. The reference symbol P designates a downward force vector being applied to the annular outer surfaces 922C of hoods 922. FIGS. 5A(*a*)–5C(*b*) are detailed perspective views which correspond to FIGS. 3A(*a*)–3C(*b*), respectively, but show the application of pressure P. FIGS. 6A(*a*)–6C(*b*) illustrate partial side elevation views of the inventive aspects of the invention of 3A(*a*)–3C(*b*), respectively, partially broken away and sectioned, showing pressure being applied to the rotary wheel hoods.

To ignite a flame, it is necessary to press downwardly upon the annular outer surfaces 922C of the rotary wheel hood 922 while simultaneously rotating the hoods in a clockwise direction. As a result of the downward force vector upon the hoods, the annular inner surfaces 922D of the hoods 922 are moved to a second position and urged against the annular unrecessed lateral portions 620A of the striker wheel 620. The striker wheel 620 will rotate in this second position against the flint 618 and generate sparks. The simultaneous action of pressing lever 616 raises nozzle 608 to release gas to ignite a flame. Release of pressure on the hoods allows them to rebound to the first safety position away from the unrecessed lateral portions of the striker wheel as shown in FIGS. 3A(*a*)–4C(*b*).

Above there has been described a unique safety lighter. It should be understood that various changes of the details, materials, arrangements of parts and uses which have been herein described and illustrated in order to explain the nature of the invention will occur to and may be made by those skilled in the art upon the reading of this disclosure, and such changes are intended to be included within the principles and scope of this invention.

What is claimed is:

1. A lighter comprising:

a lighter body having a top end;

a striker wheel, said striker wheel having a central axle and an outer annular surface, said outer annular surface of said striker wheel further comprising:

an annular recessed center portion with a rough surface formed thereon and annular unrecessed lateral portions disposed beside said annular recessed center portion;

rotary wheel hoods circumferentially surrounding said annular unrecessed lateral portions of said striker wheel, said hoods having an outer surface and an inner surface, and a central opening formed therethrough to rotatably receive said central axle, said opening having a diameter greater than said axle, said rotary wheel hoods movable from a first position to a second position to impart rotational movement to said striker wheel to create sparks, wherein said inner and outer surfaces of said hoods are smooth and the surfaces of said annular unrecessed lateral portions have protuberances thereon;

a mounting frame attached to said top end of said lighter body, said mounting frame having openings formed therethrough to rotatably receive said axle of said striker wheel, and a spring receptacle;

a spring received within said spring receptacle; and a flint;

said spring exerting a compressive force against said flint and urging said flint into contact with said rough surface of said annular recessed center portion of said striker wheel.

2. A lighter comprising:

a lighter body having a top end;

a striker wheel, said striker wheel having a central axle and an outer annular surface, said outer annular surface of said striker wheel further comprising:

an annular recessed center portion with a rough surface formed thereon and annular unrecessed lateral portions disposed beside said annular recessed center portion;

rotary wheel hoods circumferentially surrounding said annular unrecessed lateral portions of said striker wheel, said hoods having an outer surface and an inner surface, and a central opening formed therethrough to rotatably receive said central axle, said opening having a diameter greater than said axle, said rotary wheel hoods movable from a first position to a second position to impart rotational movement to said striker wheel to create sparks, wherein said inner and outer surfaces of said hoods are smooth and the surfaces of said annular unrecessed lateral portions are smooth;

a mounting frame attached to said top end of said lighter body, said mounting frame having openings formed therethrough to rotatably receive said axle of said striker wheel, and a spring receptacle;

a spring received within said spring receptacle; and a flint;

said spring exerting a compressive force against said flint and urging said flint into contact with said rough surface of said annular recessed center portion of said striker wheel.

3. A lighter comprising:

a lighter body having a top end;

a striker wheel, said striker wheel having a central axle and an outer annular surface, said outer annular surface of said striker wheel further comprising:

an annular recessed center portion with a rough surface formed thereon and annular unrecessed lateral portions disposed beside said annular recessed center portion;

rotary wheel hoods circumferentially surrounding said annular unrecessed lateral portions of said striker wheel, said hoods having an outer surface and an inner surface, and a central opening formed therethrough to rotatably receive said central axle, said opening having a diameter greater than said axle, said rotary wheel hoods movable from a first position to a second position to impart rotational movement to said striker wheel to create sparks, wherein said inner surface of said hoods is smooth, the outer surface of said hoods has protuberances thereon, and the surfaces of said annular unrecessed lateral portions have protuberances thereon;

a mounting frame attached to said top end of said lighter body, said mounting frame having openings formed therethrough to rotatably receive said axle of said striker wheel, and a spring receptacle;

a spring received within said spring receptacle; and a flint;

said spring exerting a compressive force against said flint and urging said flint into contact with said rough surface of said annular recessed center portion of said striker wheel.

4. A lighter comprising:

a lighter body having a top end;

a striker wheel, said striker wheel having a central axle and an outer annular surface, said outer annular surface of said striker wheel further comprising:

an annular recessed center portion with a rough surface formed thereon and annular unrecessed lateral portions disposed beside said annular recessed center portion;

rotary wheel hoods circumferentially surrounding said annular unrecessed lateral portions of said striker wheel, said hoods having an outer surface and an inner surface, and a central opening formed therethrough to rotatably receive said central axle, said opening having a diameter greater than said axle, said rotary wheel hoods movable from a first position to a second position to impart rotational movement to said striker wheel to create sparks, wherein said inner surface of said hoods is smooth, the outer surface of said hoods has protuberances thereon, and the surfaces of said annular unrecessed lateral portions are smooth;

a mounting frame attached to said top end of said lighter body, said mounting frame having openings formed therethrough to rotatably receive said axle of said striker wheel, and a spring receptacle;

a spring received within said spring receptacle; and a flint;

said spring exerting a compressive force against said flint and urging said flint into contact with said rough surface of said annular recessed center portion of said striker wheel.

5. A method for manufacturing a safety lighter comprising:

providing a lighter body having a top end;

providing a striker wheel, said striker wheel having a central axle and an outer annular surface, said outer annular surface of said striker wheel further comprising:

an annular recessed center portion with a rough surface formed thereon and annular unrecessed lateral portions disposed beside said annular recessed center portion;

attaching rotary wheel hoods circumferentially surrounding said annular unrecessed lateral portions of said striker wheel, said hoods having an outer surface and an inner surface, and a central opening formed therethrough to rotatably receive said central axle, said opening having a diameter greater than said axle, said rotary wheel hoods movable from a first position to a second position to impart rotational movement to said striker wheel to create sparks, wherein said inner and outer surfaces of said hoods are smooth and the surfaces of said annular unrecessed lateral portions have protuberances thereon;

attaching a mounting frame to said top end of said lighter body, said mounting frame having openings formed therethrough to rotatably receive said axle of said striker wheel, and a spring receptacle;

inserting a spring received within said spring receptacle; and inserting a flint between said spring and said striker wheel such that said spring exerts a compressive force against said flint and urges said flint into contact with said rough surface of said annular recessed center portion of said striker wheel.

6. A method for manufacturing a safety lighter comprising:

providing a lighter body having a top end;

providing a striker wheel, said striker wheel having a central axle and an outer annular surface, said outer annular surface of said striker wheel further comprising:

an annular recessed center portion with a rough surface formed thereon and annular unrecessed lateral portions disposed beside said annular recessed center portion;

attaching rotary wheel hoods circumferentially surrounding said annular unrecessed lateral portions of said striker wheel, said hoods having an outer surface and an inner surface, and a central opening formed therethrough to rotatably receive said central axle, said opening having a diameter greater than said axle, said rotary wheel hoods movable from a first position to a second position to impart rotational movement to said striker wheel to create sparks, wherein said inner and outer surfaces of said hoods are smooth and the surfaces of said annular unrecessed lateral portions are smooth;

attaching a mounting frame to said top end of said lighter body, said mounting frame having openings formed therethrough to rotatably receive said axle of said striker wheel, and a spring receptacle;

inserting a spring received within said spring receptacle; and inserting a flint between said spring and said striker wheel such that said spring exerts a compressive force against said flint and urges said flint into contact with said rough surface of said annular recessed center portion of said striker wheel.

7. A method for manufacturing a safety lighter comprising:

providing a lighter body having a top end;

providing a striker wheel, said striker wheel having a central axle and an outer annular surface, said outer annular surface of said striker wheel further comprising:

an annular recessed center portion with a rough surface formed thereon and annular unrecessed lateral portions disposed beside said annular recessed center portion;

attaching rotary wheel hoods circumferentially surrounding said annular unrecessed lateral portions of said striker wheel, said hoods having an outer surface and an inner surface, and a central opening formed therethrough to rotatably receive said central axle, said opening having a diameter greater than said axle, said rotary wheel hoods movable from a first position to a second position to impart rotational movement to said striker wheel to create sparks, wherein said inner surface of said hoods is smooth, the outer surface of said hoods has protuberances thereon, and the surfaces of said annular unrecessed lateral portions have protuberances thereon;

attaching a mounting frame to said top end of said lighter body, said mounting frame having openings formed therethrough to rotatably receive said axle of said striker wheel, and a spring receptacle;

inserting a spring received within said spring receptacle; and inserting a flint between said spring and said striker wheel such that said spring exerts a compressive force against said flint and urges said flint into contact with said rough surface of said annular recessed center portion of said striker wheel.

8. A method for manufacturing a safety lighter comprising:

providing a lighter body having a top end;

providing a striker wheel, said striker wheel having a central axle and an outer annular surface, said outer annular surface of said striker wheel further comprising:

an annular recessed center portion with a rough surface formed thereon and annular unrecessed lateral portions disposed beside said annular recessed center portion;

attaching rotary wheel hoods circumferentially surrounding said annular unrecessed lateral portions of said striker wheel, said hoods having an outer surface and an inner surface, and a central opening formed therethrough to rotatably receive said central axle, said opening having a diameter greater than said axle, said rotary wheel hoods movable from a first position to a second position to impart rotational movement to said striker wheel to create sparks, wherein said inner surface of said hoods is smooth, the outer surface of said hoods has protuberances thereon, and the surfaces of said annular unrecessed lateral portions are smooth;

attaching a mounting frame to said top end of said lighter body, said mounting frame having openings formed therethrough to rotatably receive said axle of said striker wheel, and a spring receptacle;

inserting a spring received within said spring receptacle; and inserting a flint between said spring and said striker wheel such that said spring exerts a compressive force against said flint and urges said flint into contact with said rough surface of said annular recessed center portion of said striker wheel.

* * * * *